US010080975B2

(12) United States Patent
Choi

(10) Patent No.: US 10,080,975 B2
(45) Date of Patent: Sep. 25, 2018

(54) TOY TOP

(71) Applicant: Jong-Ill Choi, Seoul (KR)

(72) Inventor: Jong-Ill Choi, Seoul (KR)

( * ) Notice: Subject to any disclaimer, the term of this patent is extended or adjusted under 35 U.S.C. 154(b) by 48 days.

(21) Appl. No.: 14/910,016

(22) PCT Filed: Aug. 22, 2014

(86) PCT No.: PCT/KR2014/007801
§ 371 (c)(1),
(2) Date: Feb. 4, 2016

(87) PCT Pub. No.: WO2015/026189
PCT Pub. Date: Feb. 26, 2015

(65) Prior Publication Data

US 2016/0175721 A1 Jun. 23, 2016

(30) Foreign Application Priority Data

Aug. 22, 2013 (KR) ..... 10-2013-0099883
Sep. 23, 2013 (KR) ..... 10-2013-0112720

(51) Int. Cl.
*A63H 1/00* (2006.01)
*A63H 1/04* (2006.01)

(52) U.S. Cl.
CPC ..... *A63H 1/04* (2013.01)

(58) Field of Classification Search
None
See application file for complete search history.

(56) References Cited

U.S. PATENT DOCUMENTS 2,846,769 A * 8/1958 Colont ..... G01B 3/20 33/710
D246,197 S * 10/1977 Iwanami ..... D21/590
D302,191 S * 7/1989 Lakin ..... D21/461
5,356,328 A * 10/1994 Ho ..... A63H 1/30 446/242
5,791,966 A * 8/1998 Capps ..... A63H 1/24 362/249.16
6,083,076 A * 7/2000 Saint-Victor ..... A63H 1/06 446/236
6,287,193 B1 * 9/2001 Rehkemper ..... A63H 1/30 273/142 H
6,634,922 B1 * 10/2003 Driscoll ..... A63H 1/30 273/142 R (Continued)

FOREIGN PATENT DOCUMENTS

CA 2425814 A1 * 10/2003 ..... A63H 1/04
JP 2003-305282 A 10/2003

(Continued)

OTHER PUBLICATIONS

English translation of the Written Opinion of the International Searching Authority for PCT/KR2014/007801 (14 pages).*

(Continued)

*Primary Examiner* — John E Simms, Jr.
*Assistant Examiner* — Urszula M Cegielnik
(74) *Attorney, Agent, or Firm* — NSIP Law

(57) ABSTRACT

The present invention relates to an improved spinning top toy capable of being movable while the top is spinning, and easily coupling a launcher for rotating and launching the top and a winder for providing the top with a rotational force.

14 Claims, 18 Drawing Sheets

(56) References Cited

U.S. PATENT DOCUMENTS 6,743,070 B1 * 6/2004 Lin ..... A63H 1/02 446/15
6,932,324 B2 * 8/2005 Biller ..... B60R 22/1952 254/230
7,252,618 B2 * 8/2007 Spakowski ..... F02M 26/54 475/343
7,427,225 B2 * 9/2008 Matsukawa ..... A63H 1/04 446/256
7,448,934 B2 * 11/2008 Van Dan Elzen ..... A63H 1/30 446/236
D637,661 S * 5/2011 Horikoshi ..... D21/453
8,715,032 B2 * 5/2014 Horikoshi ..... A63H 1/12 446/256
9,180,379 B2 * 11/2015 Choi ..... A63H 1/02
2003/0064660 A1 * 4/2003 Matsukawa ..... A63F 3/00895 446/256
2003/0077977 A1 * 4/2003 Polare ..... A63H 1/04 446/256
2003/0199222 A1 * 10/2003 Matsukawa ..... A63H 30/04 446/256
2005/0040598 A1 * 2/2005 Wilk ..... A63F 3/00697 273/288
2005/0277360 A1 * 12/2005 Benedek ..... A63H 1/00 446/236
2009/0253343 A1 * 10/2009 Kitamura ..... A63F 9/16 446/256
2012/0088433 A1 * 4/2012 Choe ..... A63H 1/02 446/256
2013/0324004 A1 * 12/2013 Schwartz ..... A63H 30/04 446/259
2015/0017872 A1 * 1/2015 Choi ..... A63H 1/02 446/259
2016/0328426 A1 * 11/2016 Muraki ..... G06F 17/30312

FOREIGN PATENT DOCUMENTS

JP 3098449 U 10/2003
JP 3612508 B2 10/2004
KR 20-0216555 Y1 3/2001

OTHER PUBLICATIONS

International Search Report dated Dec. 16, 2014 in counterpart International Application No. PCT/KR2014/007801 (4 pages with English translation).

* cited by examiner

【FIG. 1】

- Prior Art-

【FIG. 5】
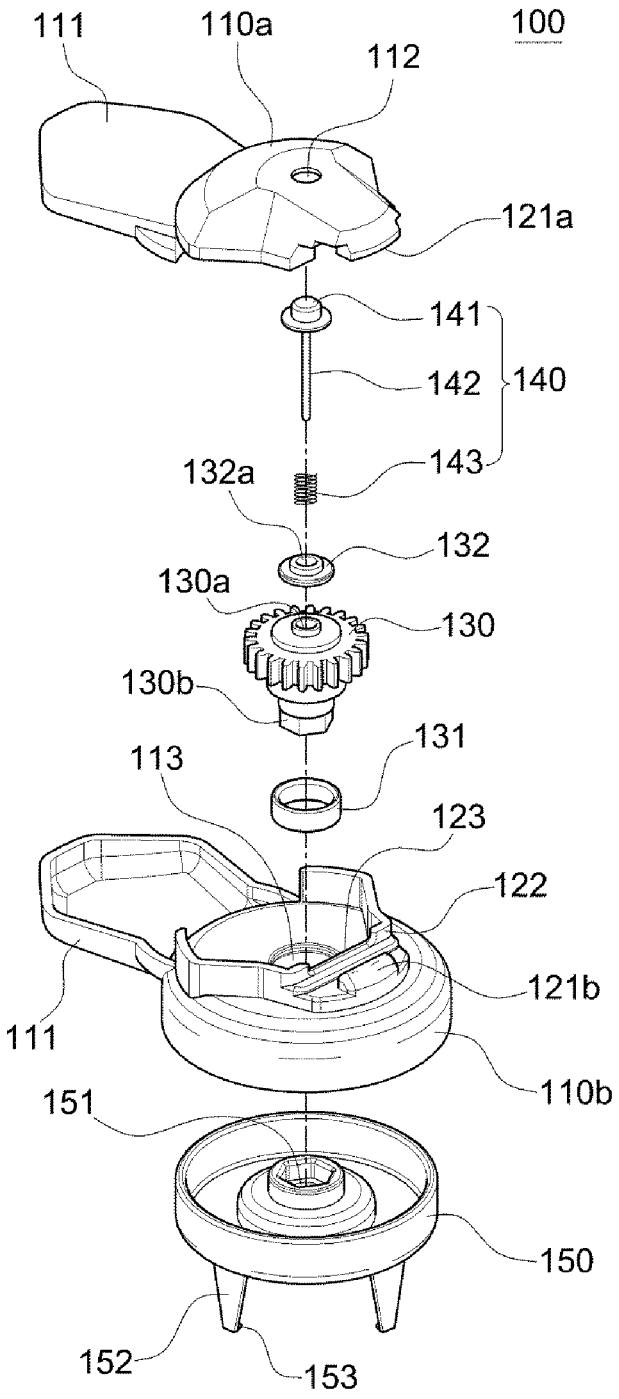

【FIG. 6】
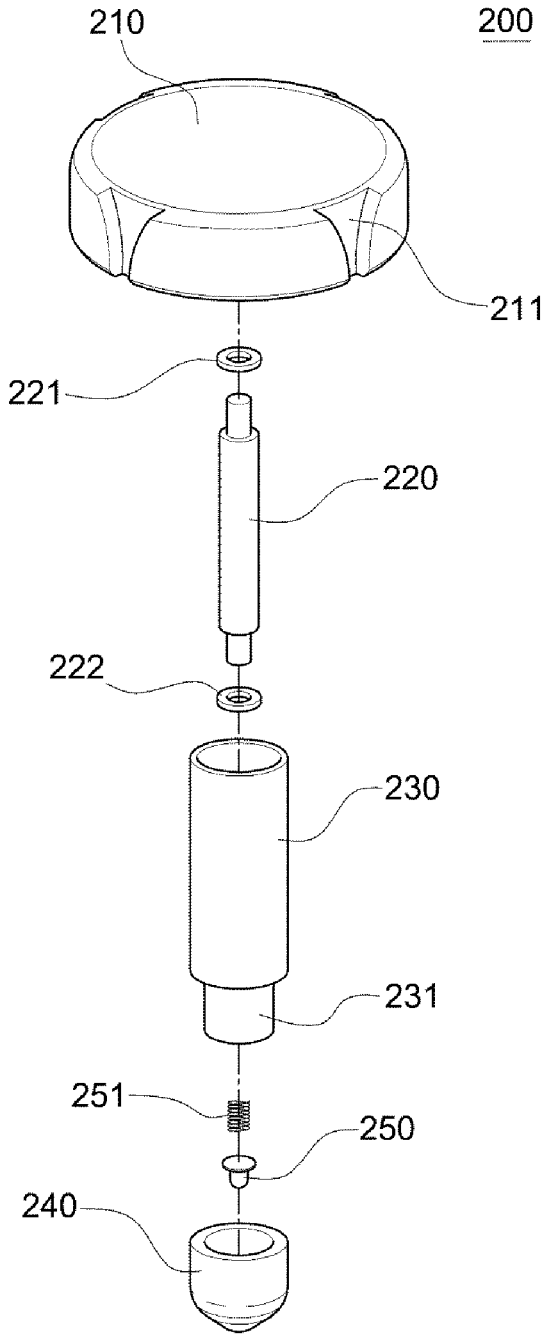

【FIG. 7】
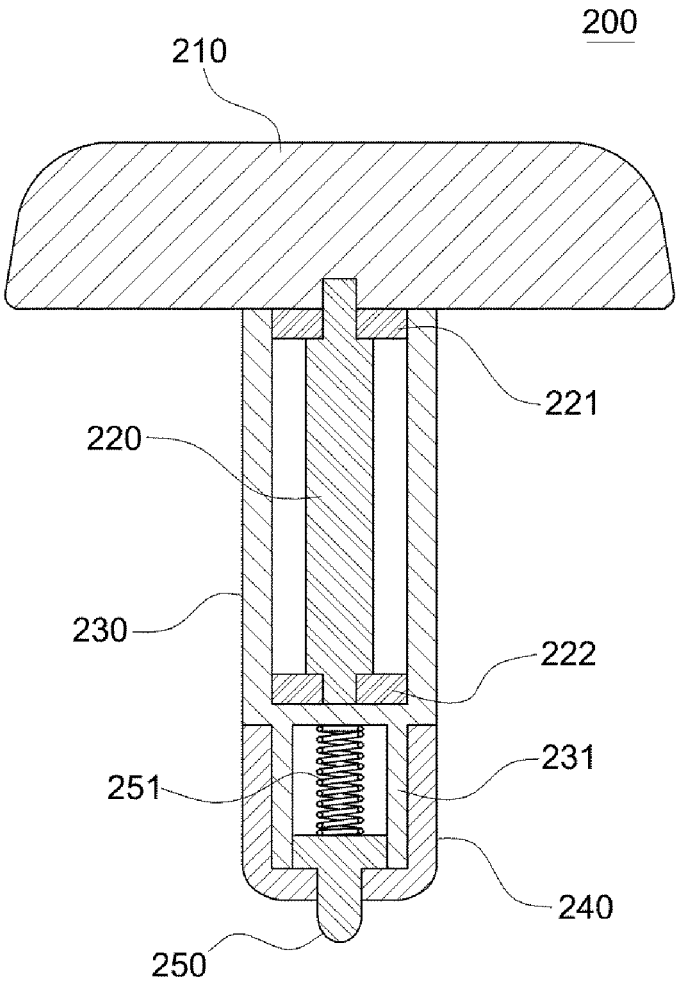

【FIG. 8】
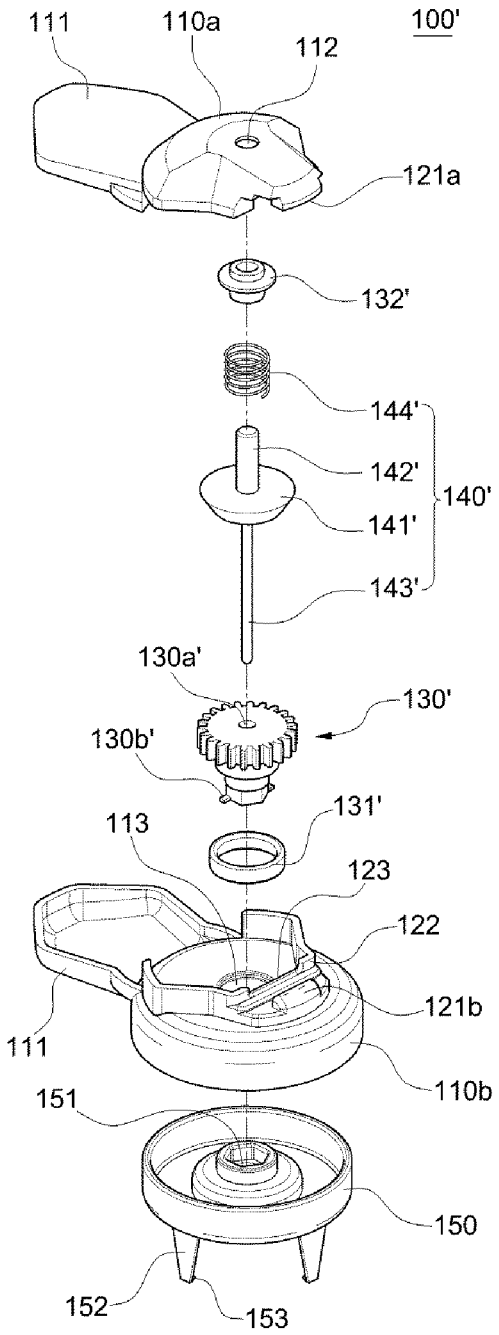

【FIG. 9】
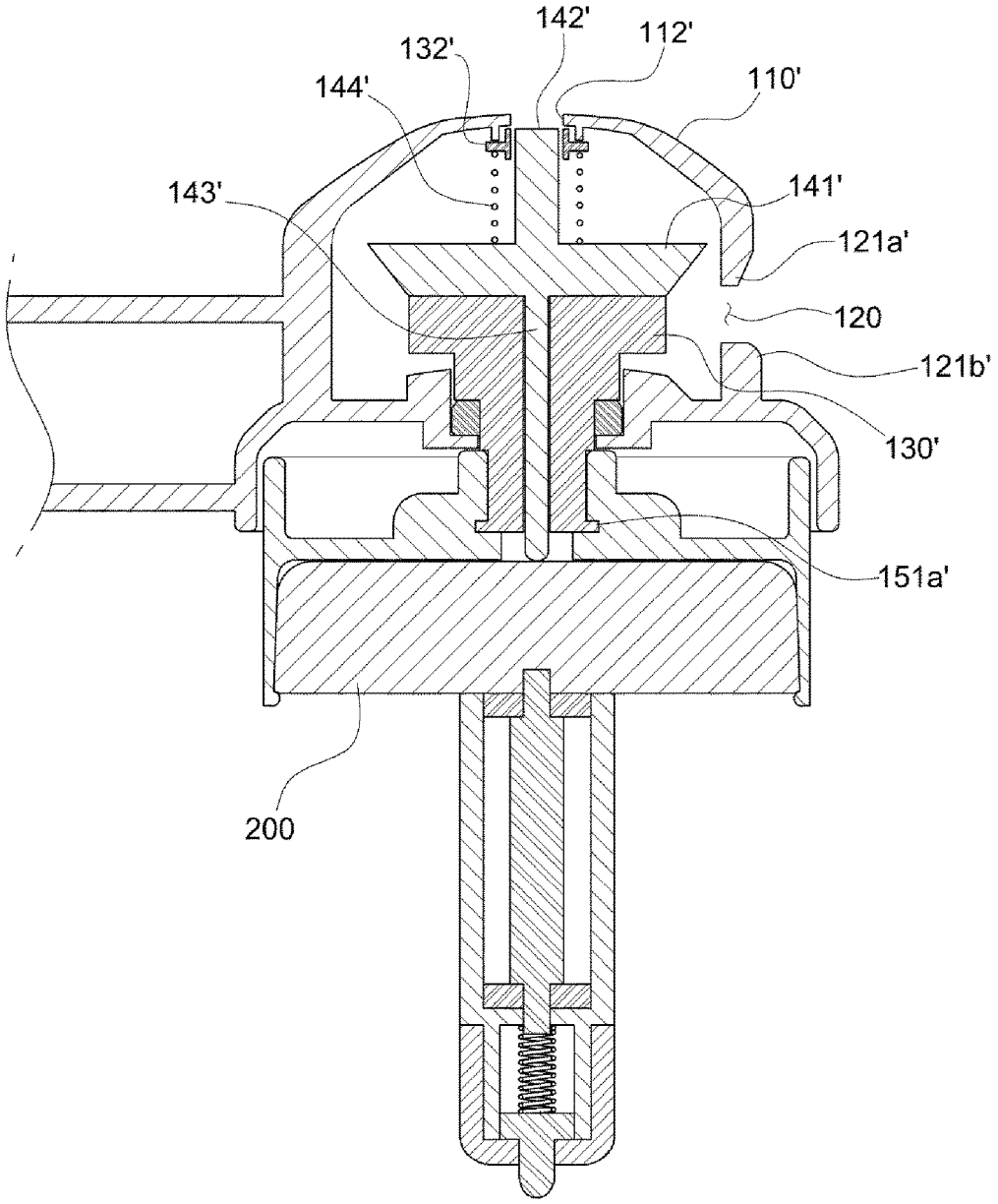

【FIG. 10】
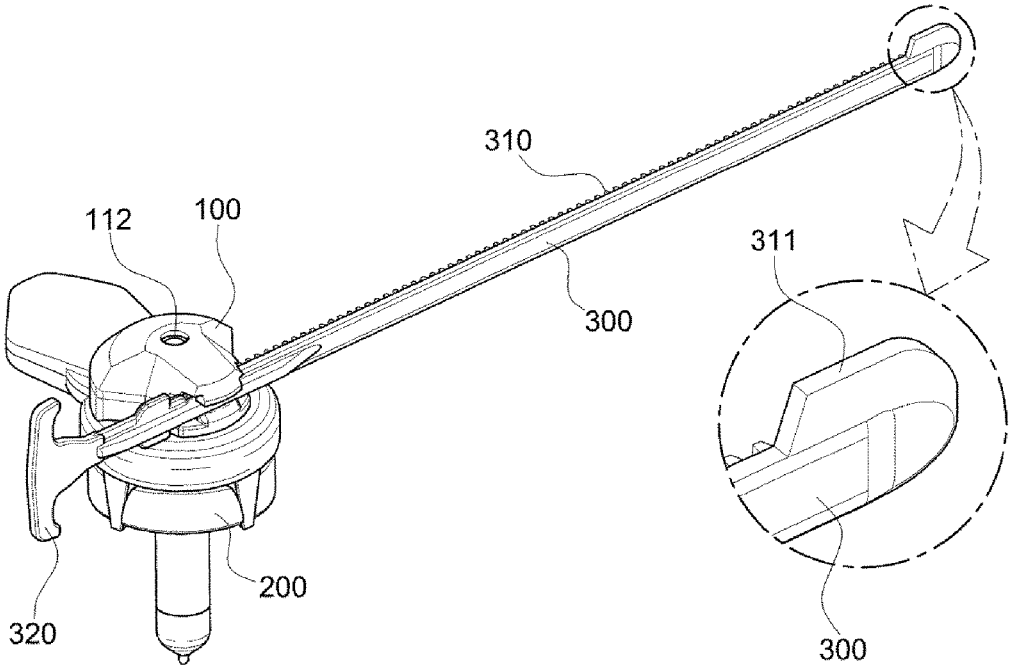

【FIG. 11】
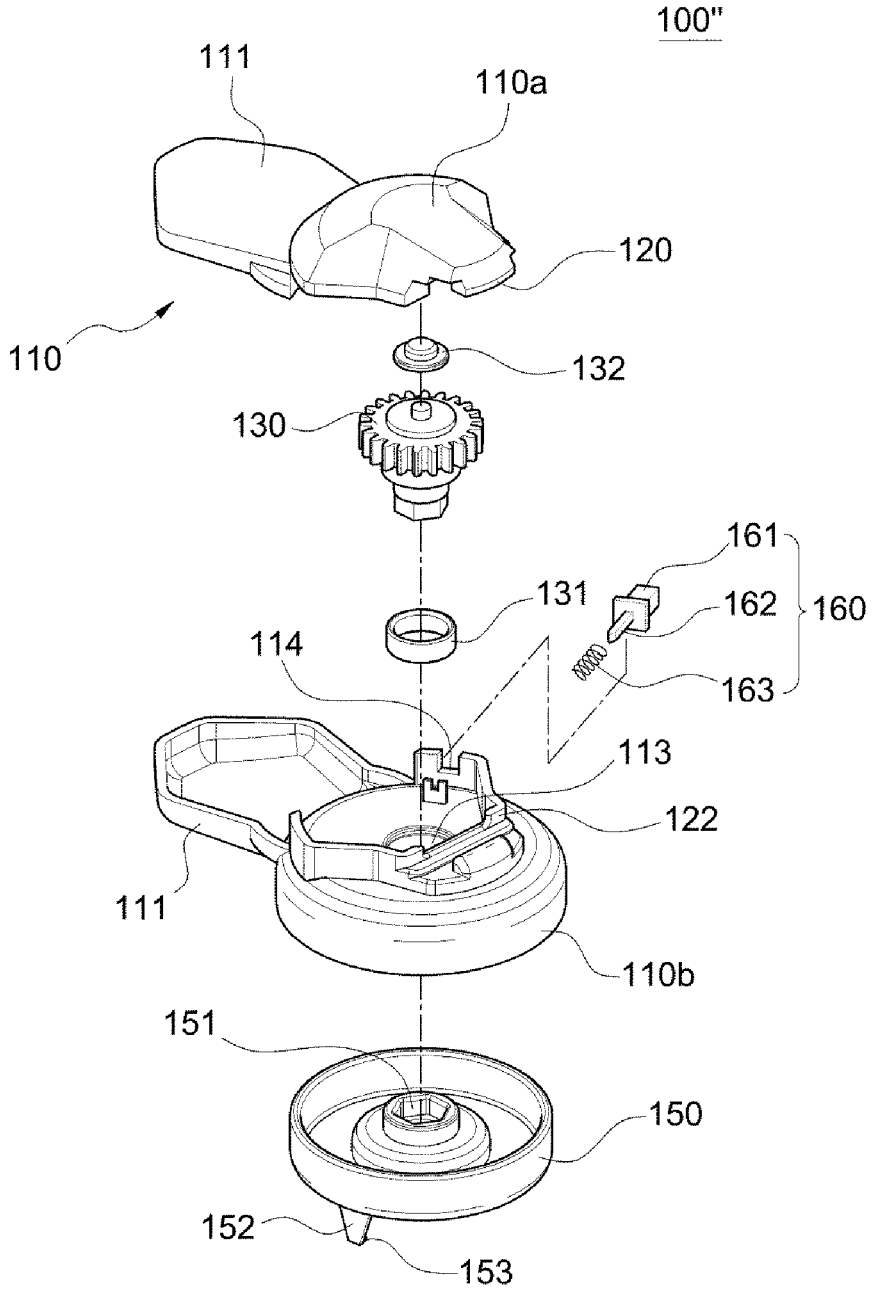

【FIG. 12】
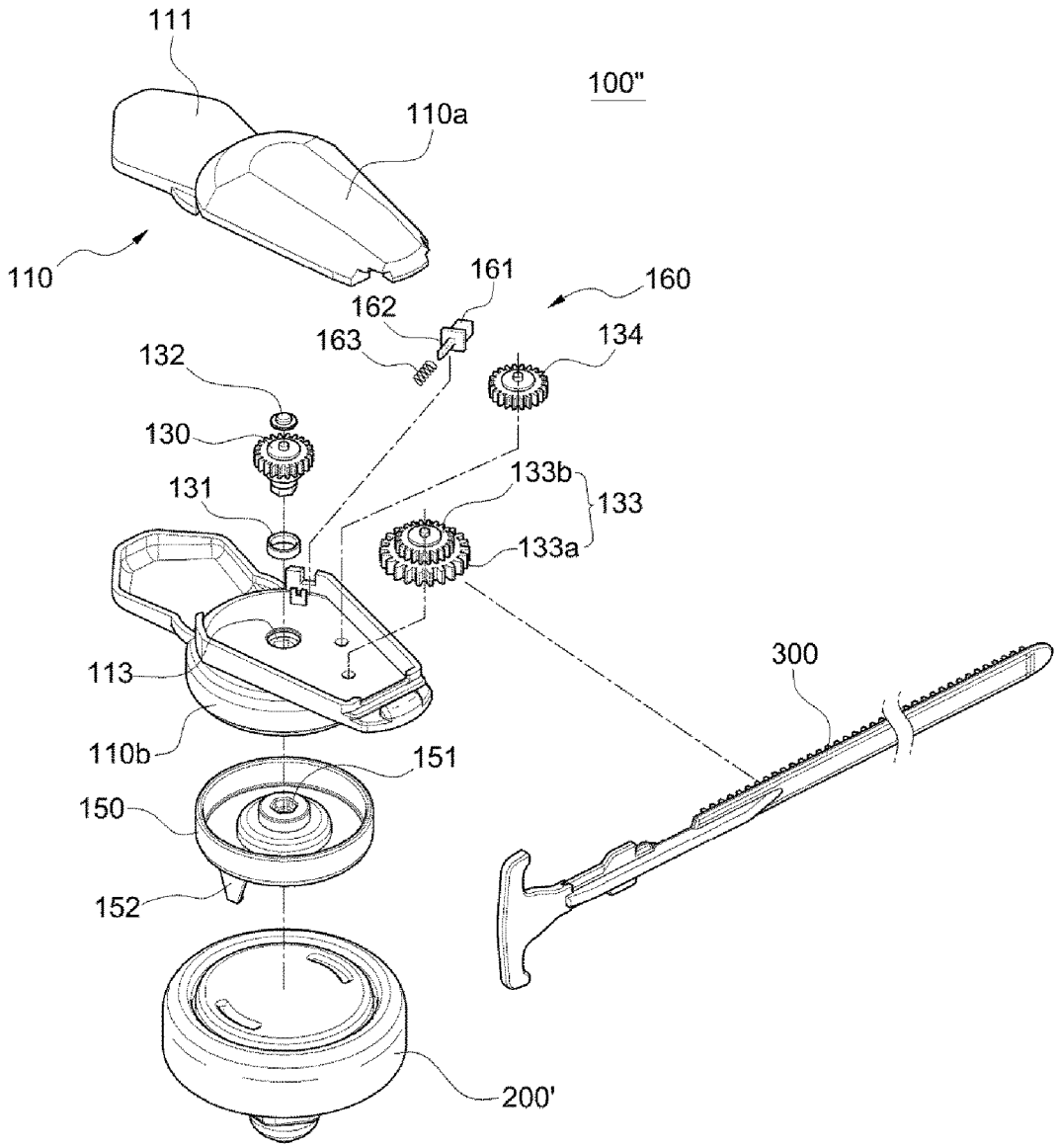

【FIG. 13】
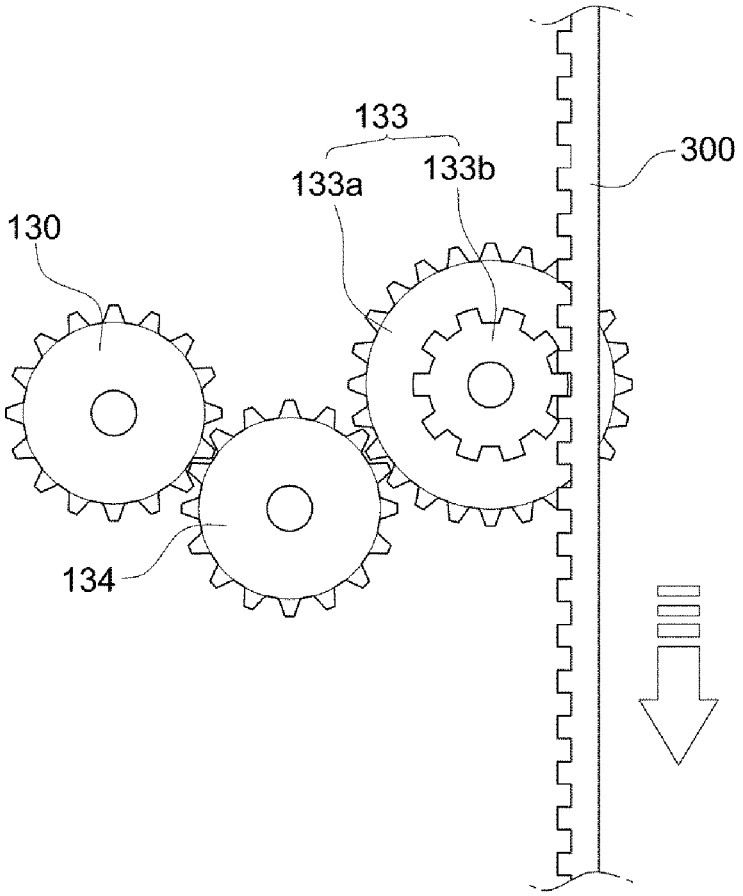

【FIG. 14】
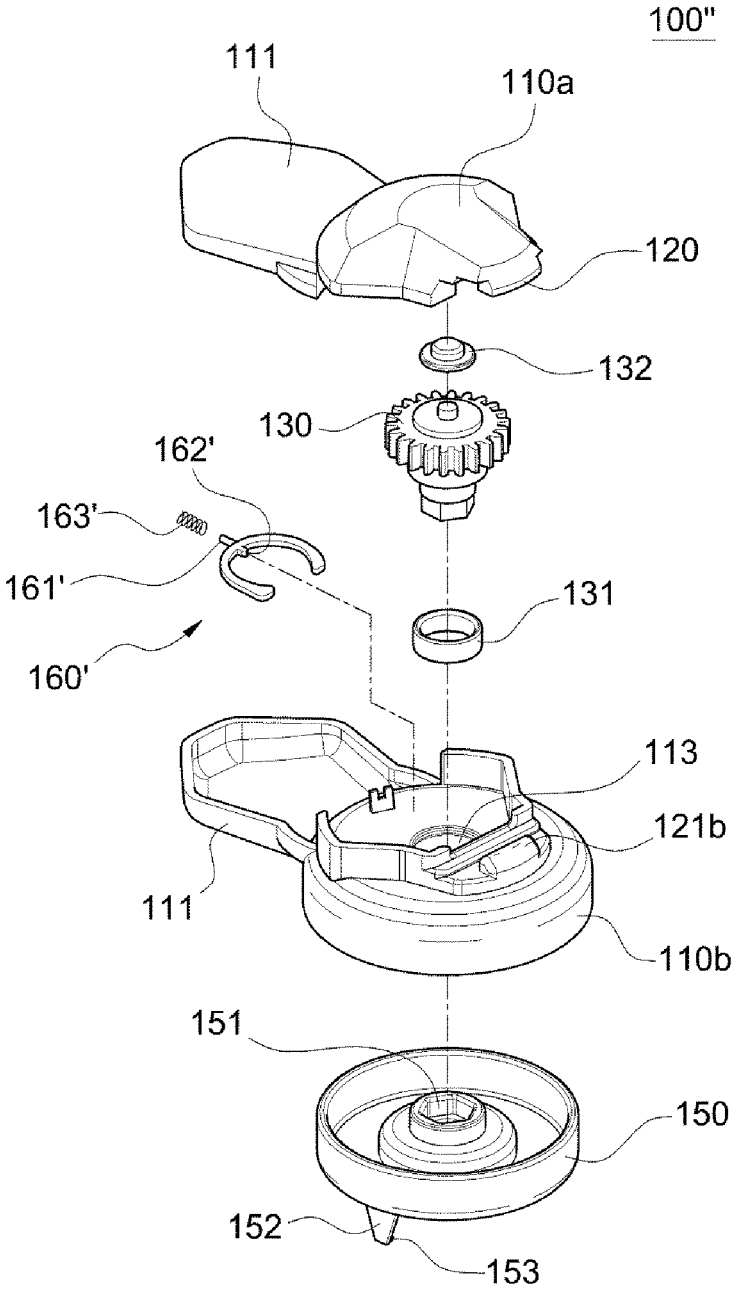

【FIG. 15】
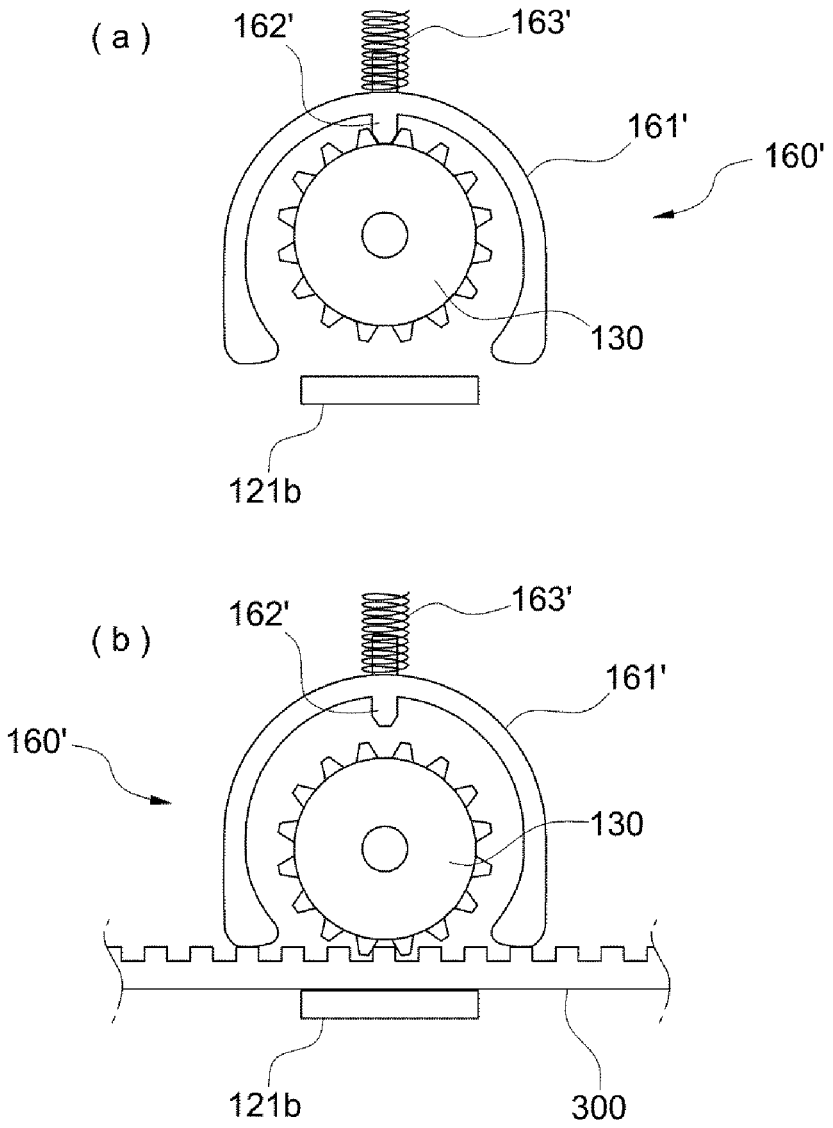

【FIG. 16】
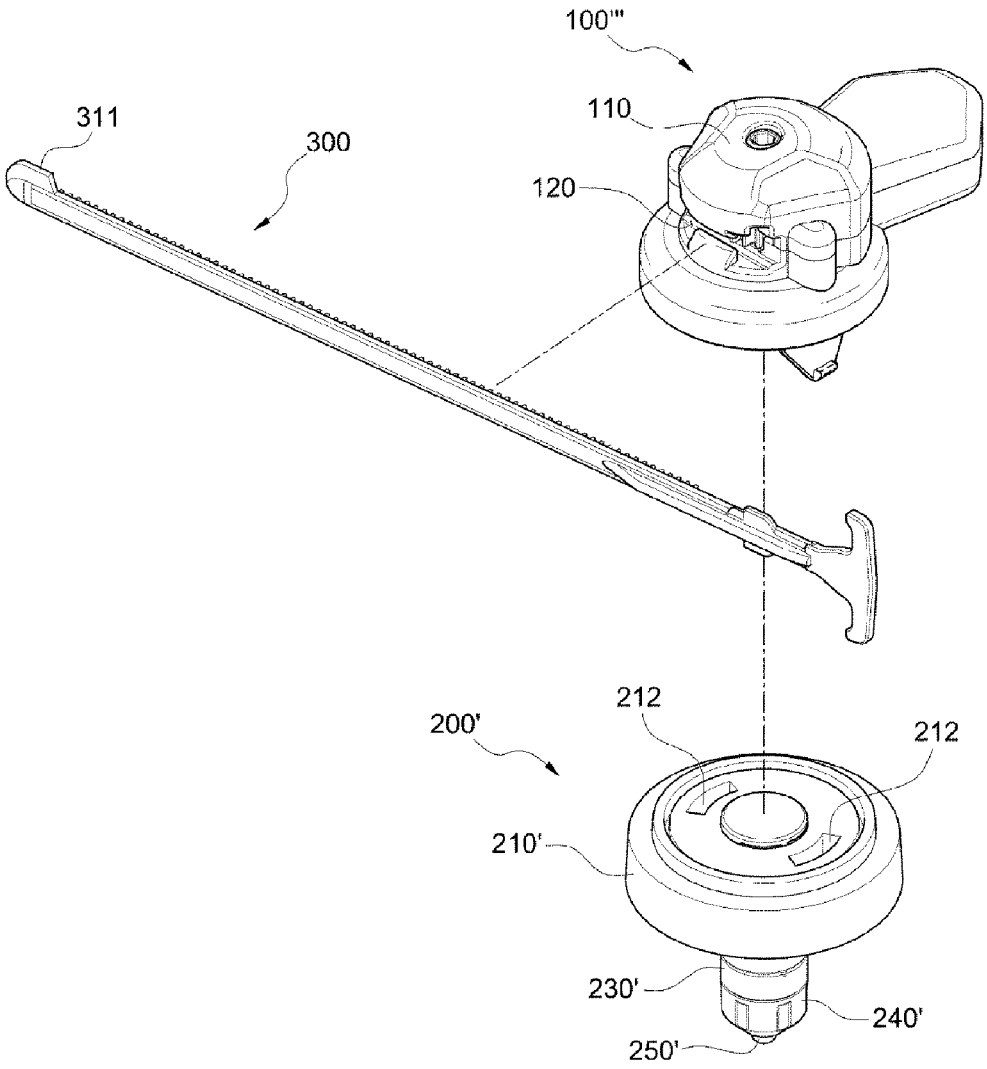

【FIG. 17】
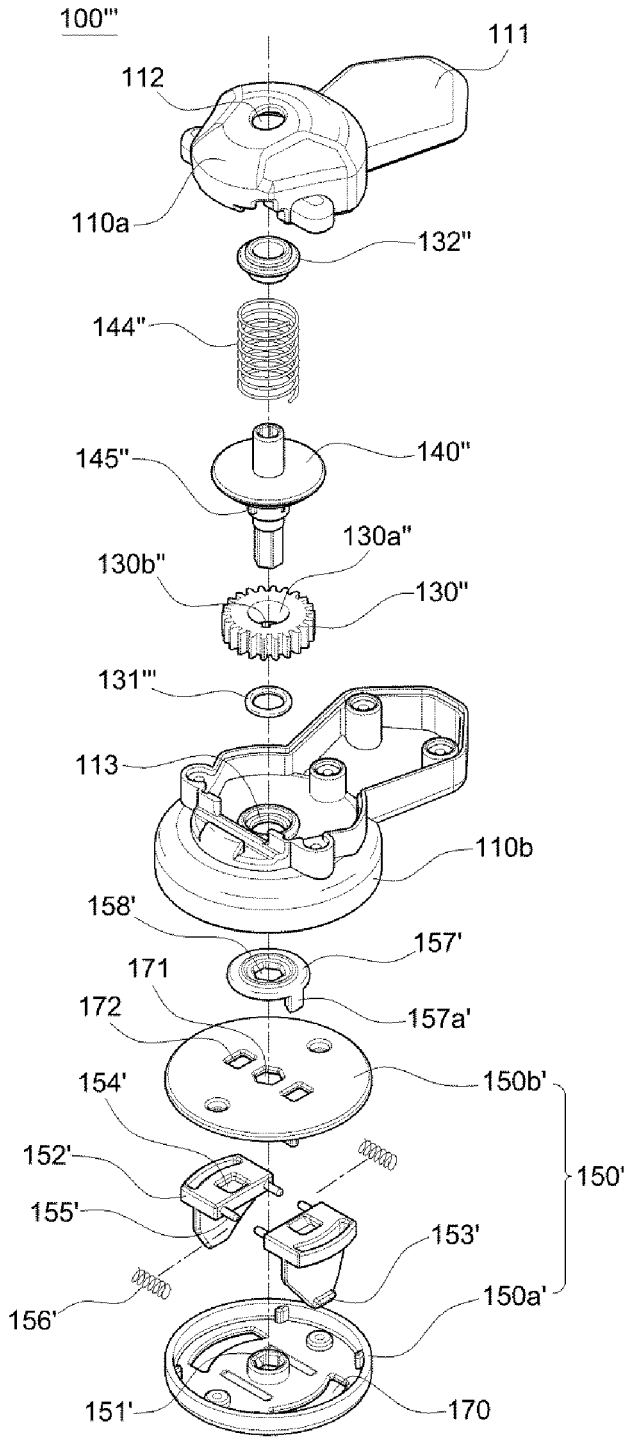

【FIG. 18】
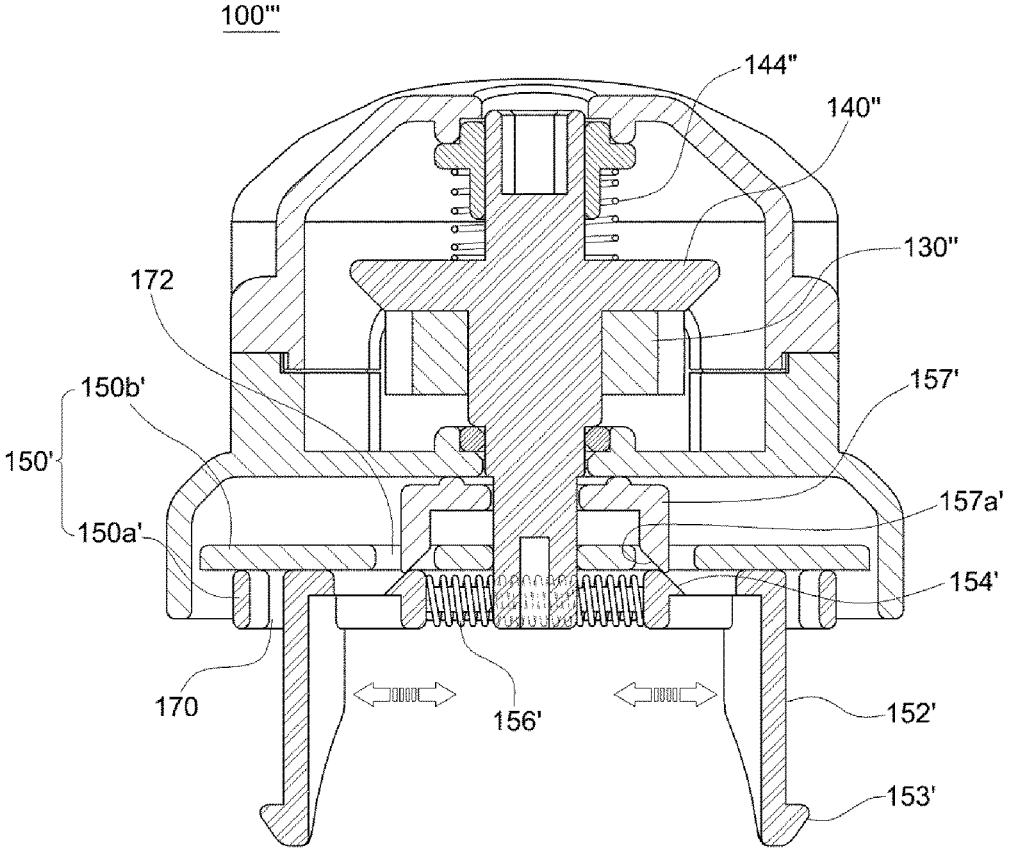

TOY TOP

CROSS REFERENCE TO RELATED APPLICATION(S)

This application is a National Phase entry of PCT Application No. PCT/KR2014/007801, filed on Aug. 22, 2014, which claims priority under 35 U.S. C. § 119(e), 120 and 365(c) to Korean Patent Applications Nos. 10-2013-0099883 and 10-2013-0112720, filed on Aug. 22, 2013 and Sep. 23, 2013 respectively, in the Korean Intellectual Property Office, the entire disclosures of each of which are incorporated herein by reference for all purposes.

TECHNICAL FIELD

The present invention relates to a spinning top toy, and more particularly, to an improved spinning top toy capable of being movable while the top is spinning, and easily coupling a launcher for rotating and launching the top and a winder for providing the top with a rotational force.

BACKGROUND ART

A spinning top is a kind of toy which is very popular with children, and the children compete with each other by striking tops or bouncing out from an arena, wherein the last top still spinning wins.

Korea Utility Model Laid-open No. 2011-0010131 (published on Oct. 26, 2011, entitled "Spinning Toy Launcher") discloses a spinning top toy including a launcher for launching a spinning top by pulling a rack belt out, and the rack belt is configured to drive a drive mechanism installed in a launcher body.

FIG. 1 is a perspective view illustrating the configuration of a spinning top toy according to the related art. As illustrated in FIG. 1, the spinning top toy according to the related art includes a top 10 of an inverted conical shape having on a top surface an insertion groove 11 which is fastened to a top launcher 20, the top launcher 20 for spinning and launching the top 10, and a winder 30 for providing the top launcher 20 with a rotational force.

The top launcher 20 has a rotor 21 and a top fastener 22 which are provided at a lower portion, a winder through-hole 23 formed in one side through which the winder 30 goes, and a pinion gear 24 which is meshed with a rack gear 31 of the winder 30 to rotate the rotor 21.

The winder 30 has a winder body 31 of a strap shape with the rack gear 31 formed on one side, and a pull tab 32 provided at a front end of the winder body 31.

The winder body 31 of the winder 30 is inserted into the winder through-hole 23 of the top launcher 20, and if a user pulls the inserted winder 30 out, the pinion gear 24 of the top launcher 20 is rotated by the rack gear of the winder body 31, thereby rotating the top 10 coupled to the rotor 21. If the pinion gear 24 stops, the top 10 is released from the top fastener 22 by an inertia.

The spinning top toy according to the related art has a problem in that since the winder 30 should be inserted into the winder through-hole 23 of the top launcher 20, and then be moved to a position of ripping action, from which where the winder 30 is pulled out, the operation is cumbersome.

DISCLOSURE

Technical Problem

Accordingly, the present invention has been made in view of the above-mentioned problems, and an object of the present invention is to provide an improved spinning top toy capable of being movable while the top rotates, and easily coupling a launcher for rotating and launching the top and a winder for providing the top with a rotational force.

Technical Solution

To accomplish the above-mentioned object, according to one aspect of the present invention, there is provided a spinning top toy including: a launcher having a winder coupling portion which is formed at one side of a launcher housing by cutting the side so that a portion of a winder is inserted into the side and is moved, a pinion gear which is meshed with and rotated by the winder, a top driver for rotating a top in cooperation with the pinion gear, and a top separator which is configured to separate the top from the top driver; the top which is coupled to a lower portion of the launcher, and is selectively separated from the top driver according to operation of the top separator of the launcher; and the winder with a portion being inserted into the winder coupling portion of the launcher, the winder being horizontally moved along the winder coupling portion in the insertion state to rotate the pinion gear.

The launcher may further have an acceleration pinion gear which is meshed with the pinion gear to increase the number of revolutions of the pinion gear to be rotated by the winder.

The top separator of the launcher may be a launch button which penetrates the launcher housing, the pinion gear, and the top driver, and the launch button is operated by a press force of a user to press the top, so that the top is separated from the top driver.

The top separator of the launcher may be a launch firing pin which penetrates the launcher housing, the pinion gear, and the top driver, and the launch firing pin is operated by a press force of a user to press the top, so that the top is separated from the top driver.

The top separator of the launcher may be a stopper which is placed at one side of the launcher housing, and is meshed with the pinion gear to stop rotation of the pinion gear, so that the top is separated from the top driver by an inertial force.

The stopper may have a stopper shaft which is installed at one side of the pinion gear, and is meshed with the pinion gear to selectively stop the rotation of the pinion gear, and a spring for providing a resilient force to the stopper shaft so that the stopper shaft is kept at a proper position.

The top separator of the launcher may be a launch operator which penetrates the launcher housing, the pinion gear, and the top driver, and moves the top driver in a vertical direction, so that the top is separated from the top driver.

The top driver may have a lower housing which is formed with a pinion gear engaging groove, to which the top separator is engaged, and a coupling portion penetrating hole through which the coupling portion penetrates, a top housing which is installed on the lower housing, and is formed with a first through-hole through which the top driver penetrates, and a second through-hole through which an insertion boss of the support penetrates, a pair of coupling portions which are installed in coupling portion penetrating holes of the lower housing to be able to move to each other, the coupling portions being spaced apart from each other in a desired distance, and which are formed with a stepped portion at a distal end thereof, a coupling portion guide which is formed at an upper end of each coupling portion, and has an inclined groove, a spring which is installed between the coupling portions to resiliently maintain a gap between the coupling portions at a desired distance, and a support which has an inclined insertion boss formed at distal end thereof which penetrates the upper housing, the insertion boss being fitted into the coupling portion guide of the coupling portion so that the coupling portion is supported to move inwardly in a radial direction.

The top driver may have a plurality of coupling portions which extend from a bottom surface thereof in a desired length and are coupled to a blade of the top.

The winder may have a rack gear portion of a strap shape with a rack gear formed on one side, a pull tab formed on a front end of the other side, and a winder coupling portion inserting groove which is formed by cutting a portion of the rack gear portion in a longitudinal direction to have a desired size so that the rack gear portion is inserted into the winder coupling portion inserting groove, and the rack gear portion is provided with a protrusion of a desired size protruding from a distal end thereof.

The top may include a blade which is formed with a top driver coupling groove to be coupled to the coupling portion of the top driver, a top shaft which is fixed to a lower portion of the blade, a top housing which is installed to the lower portion of the blade to receive the top shaft in a rotatable state, and a bottom which is detachably installed to a lower portion of the top housing and has a bottom rotation shaft so that the top spins on the ground.

The bottom rotation shaft may be detachably coupled to the bottom, so that the bottom rotation shaft can be replaced.

The bottom further may have a spring which is installed between the top shaft and the bottom rotation shaft to provide a resilience force so that a desired interval is maintained between the bottom rotation shaft and the top shaft.

The top may include a blade which is formed at an upper portion thereof with a plurality of top driver coupling grooves to be coupled to the coupling portions of the top driver, and at a lower portion thereof with a top shaft, a top housing which is installed to the lower portion of the blade to receive the top shaft in a rotatable state, and a bottom which is installed to a lower portion of the top housing to support the top in a rotatable state.

Advantageous Effects

With the above configuration of the spinning top toy according to the present invention, in the state in which the top is spinning after the top is launched from the launcher, the top can be moved, thereby improving the amusement at the spinning top play.

Also, the rotating state of the top can be maintained in the launcher, and the spinning top can be released at the wanted launch position, thereby further improving the amusement at the spinning top play.

In addition, the winder can be easily coupled to the launcher in the state in which the top is coupled to the launcher and is rotated, thereby increasing the rotational force of the spinning top.

DESCRIPTION OF DRAWINGS

FIG. 5 is an exploded perspective view illustrating the configuration of a launcher for the spinning top toy in FIG. 2.

FIG. 6 is an exploded perspective view illustrating the configuration of a top for the spinning top toy in FIG. 2.

FIG. 7 is a cross-sectional view illustrating the configuration of the top for the spinning top toy in FIG. 2.

FIG. 8 is an exploded perspective view illustrating the configuration of a launcher for a spinning top toy according to a second embodiment of the present invention.

FIG. 9 is a cross-sectional view illustrating the configuration of the launcher for the spinning top toy in FIG. 8.

FIG. 10 is a perspective view illustrating an assembled state of the spinning top toy in FIG. 8.

FIG. 11 is an exploded perspective view illustrating the configuration of a launcher for a spinning top toy according to a third embodiment of the present invention.

FIG. 12 is an exploded perspective view illustrating another embodiment of the configuration of a pinion gear for the launcher in FIG. 11.

FIG. 13 is a view illustrating the configuration of the pinion gear in FIG. 12.

FIG. 14 an exploded perspective view illustrating another embodiment of the configuration of a stopper for the launcher in FIG. 11.

FIG. 15 is s view illustrating an operating process of the stopper in FIG. 14.

FIG. 16 is a perspective view illustrating a spinning top toy according to a fourth embodiment of the present invention.

FIG. 17 is an exploded perspective view illustrating the configuration of a launcher for the spinning top toy in FIG. 16.

FIG. 18 is an exploded perspective view illustrating a coupled state of the launcher for the spinning top toy in FIG. 16.

MODE FOR INVENTION

Hereinafter, preferred embodiments of a spinning top toy according to the present invention will be described in detail with reference to the accompanying drawings.

First Embodiment

Figure 1:
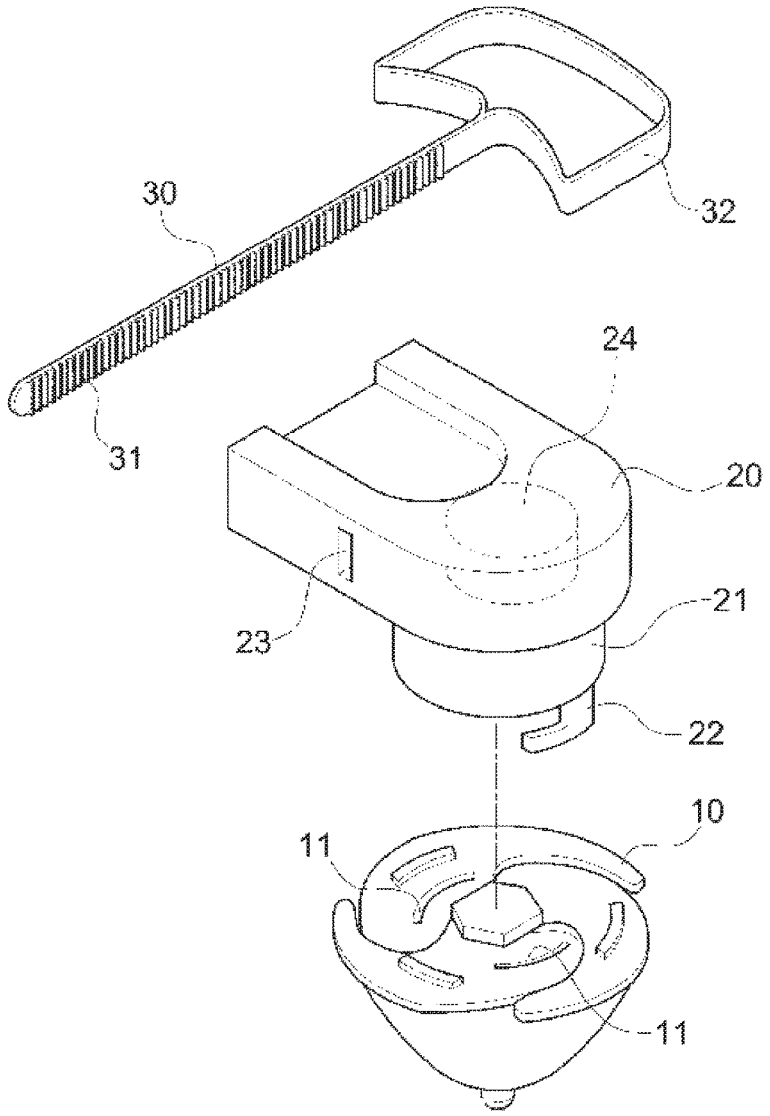
FIG. 1 is a perspective view illustrating the configuration of a spinning top toy according to the related art.
Figure 2:
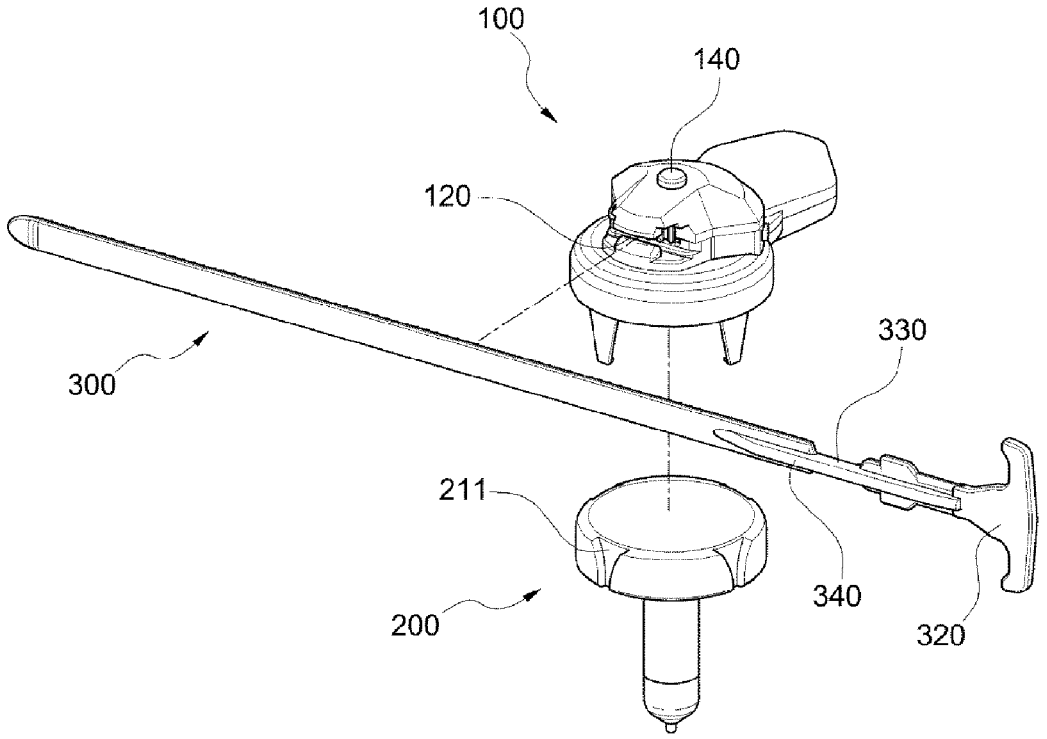
FIG. 2 is a perspective view illustrating a spinning top toy according to a first embodiment of the present invention.
Figure 3:
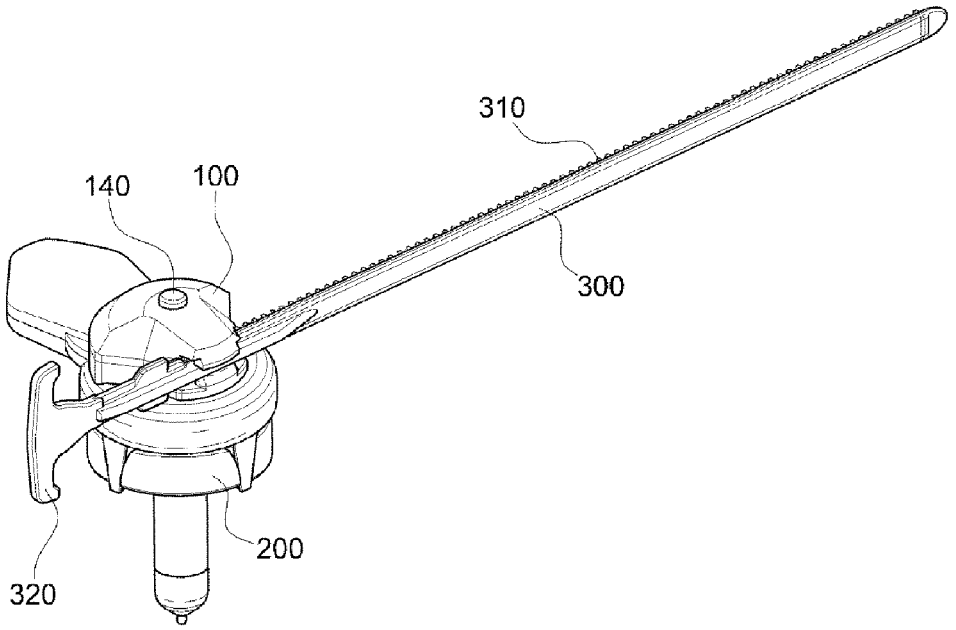
FIG. 3 is a perspective view illustrating an assembled state of the spinning top toy in FIG. 2.
Figure 4:
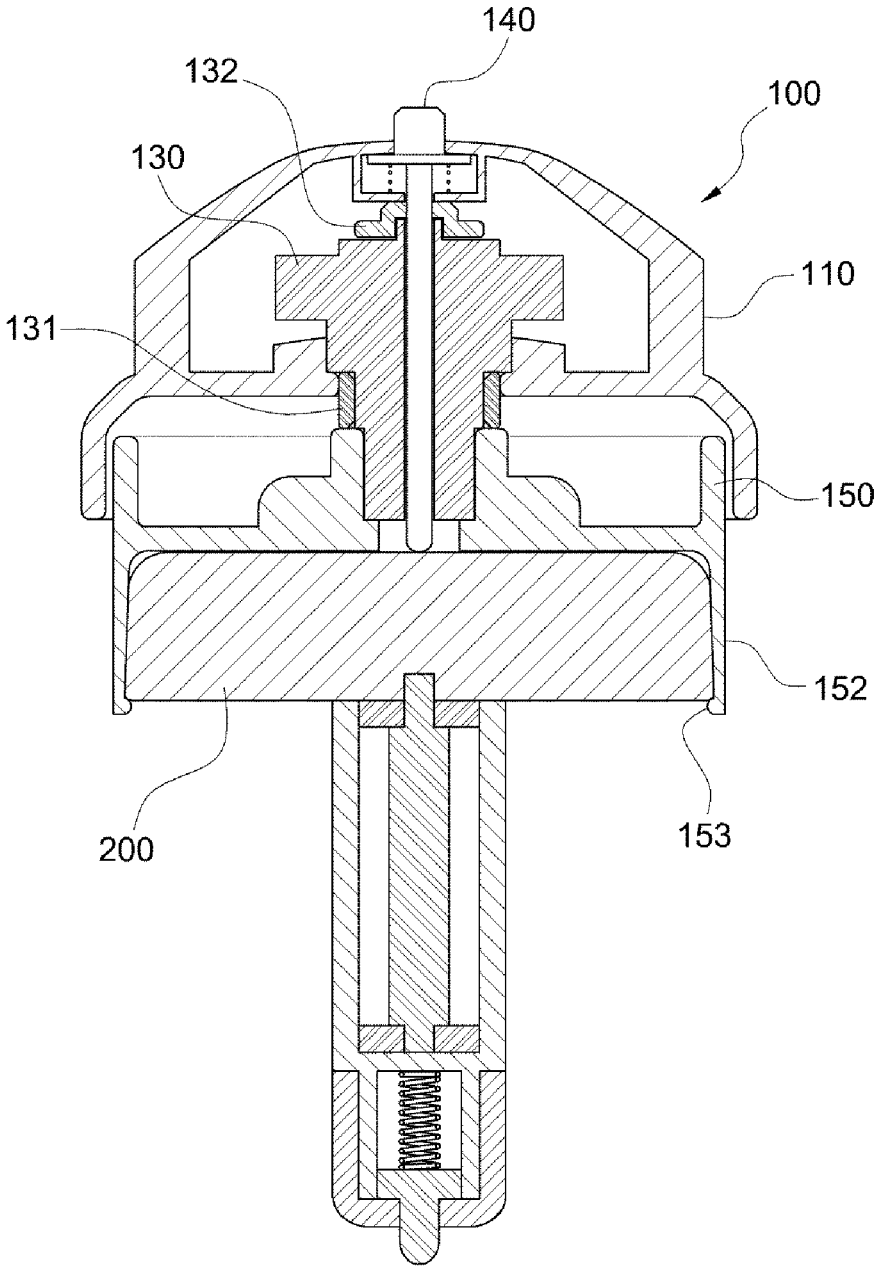
FIG. 4 is a cross-sectional view illustrating the configuration of the spinning top toy in FIG. 2.

FIG. 2 is a perspective view illustrating the spinning top toy according to the first embodiment of the present invention. FIG. 3 is a perspective view illustrating an assembled state of the spinning top toy in FIG. 2. FIG. 4 is a cross-sectional view illustrating the configuration of the spinning top toy in FIG. 2. FIG. 5 is an exploded perspective view illustrating the configuration of a launcher for the spinning top toy in FIG. 2. FIG. 6 is an exploded perspective view illustrating the configuration of a top for the spinning top toy in FIG. 2. FIG. 7 is a cross-sectional view illustrating the configuration of the top for the spinning top toy in FIG. 2.

As illustrated in FIGS. 2 to 7, the spinning top toy according to the present invention is movable while a top is spinning, and includes a launcher 100 for rotating and launching the top, the launcher 100 being easily coupled to a winder for providing the top with a rotational force, a top 200, and a winder 300.

The launcher 100 includes a launcher housing 110 which receives a portion of the winder 300 at one side, transmits the rotational force generated by horizontal movement of the winder 300 to the top 200 coupled to a lower portion to rotate the top 200, and separates the spinning top 200 at an any position from the launcher 100, a winder coupling portion 120, a pinion gear 130, a launch button 140, and a top driver 150.

The launcher housing 110 has an accommodation space to accommodate the pinion gear 130 and the launch button 140 therein in such a way that the pinion gear and the launch button can rotate. The launcher housing 110 is provided at one side with a tab 111 by which the user can hold the launcher 100, and at the other side with a space which is cut in a desired size so that the winder 300 can move horizontally along a desired route when a portion of the winder 300 is inserted into the launcher housing 110 and is brought into closely contact with the space.

Also, the launcher housing 110 has an upper housing 110*a* and a lower housing 110*b*. The upper housing 110*a* is formed with a launch button installing hole 112 from which a portion of the launch button 140 protrudes, and the lower housing 110*b* is formed with a pinion gear installing hole 113 through which a portion of the pinion gear 130 penetrates.

The winder coupling portion 120 is a cut space which is formed at one side of the launcher housing 110, and has a first upper guide 121*a*, a first lower guide 121*b*, and a second guide 122 which form a route in such a way that a portion of the winder 300 is inserted into the space and is brought into closely contact with the pinion gear 130 installed in the launcher housing 110, and then the winder 300 closely contacted is moved along the side of the launcher housing 110 in a horizontal direction.

The first upper guide 121*a* is provided at one side of the upper housing 110*a*, and the first lower guide 121*b* is provided at one side of the lower housing 110*b* to be spaced apart from and parallel to the first upper guide 121*a* at a desired distance. A portion of the winder 300 is inserted into a space between the first upper guide 121*a* and the first lower guide 121*b*.

The second guide 122 is installed in the upper and lower housings 110*a* and 110*b* which are spaced apart from and opposite to the first upper and lower guides 121*a* and 121*b* at a desired distance, and prevents the winder 300, which is inserted into the space between the first upper and lower guides 121*a* and 121*b*, from further inserting into the launcher housing 110. Also, the second guide 122 form a route so that the inserted winder 300 can move along the launcher housing 110 in the horizontal direction.

Also, the second guide 122 is provided with a gear penetrating portion 123 through which the rack gear formed on the inserted winder 300 is meshed with the pinion gear 130 installed to the launcher housing 110.

The pinion gear 130 is installed in the launcher housing 110, and is meshed with the winder 300 to rotate the top driver 150, and has a lower bearing 131 and an upper bearing 132 which are rotatably installed in the launcher housing 110 and support a rotation shaft of the pinion gear 130 on the launcher housing 110 so that the pinion gear 130 can smoothly rotate in the launcher housing 110.

The lower bearing 131 is installed in a pinion gear installing hole 113 formed in the lower housing 110*b* to smoothly rotate the pinion gear 130, and the upper bearing 132 is installed in the upper housing 110*a* to smoothly rotate the pinion gear 130.

Also, the pinion gear 130 and the upper bearing 132 are formed with through-holes 130*a* and 132*a*, respectively, through which a portion of the launch button 140 penetrates.

The launch button 140 is a top separator which is installed to the upper housing 110*a* of the launcher housing 110 and penetrates the launcher 100 in the vertical direction so that the top 200 coupled to the top driver 150 is separated from the top driver 150. The launch button 140 has a launch button body 141 installed in the launch button installing hole 112 of the upper housing 110*a*, a launch button firing pin 142 extending from the launch button body 141 in a desired length and penetrating the launcher 100 to press the upper portion of the top 200 and thus separate the top 200, and a spring 143 for providing a resilient force so that the launch button body 141 is kept at a desired position.

The top driver 150 has a pinion gear engaging groove 151 formed at a body center of the top driver 150 to be rotated in cooperation with the pinion gear 130, and is coupled to the rotation shaft of the pinion gear 130. The top driver 150 is rotatably installed to the bottom surface of the launcher housing 110. Coupling portions 152 extend downwardly from the bottom surface of the top driver 150 to be detachably coupled to top driver coupling grooves 211 which are formed on a circumference of a blade 210 of the top 200.

The top driver 150 has a diameter larger than that of the blade 210 of the top 200, so that the circumference of the blade 210 of the top 200 can be stably coupled to the coupling portions 152.

The coupling portion 152 is a V-shaped member, and an inner lower portion of the coupling portion 152 is formed with a stepped portion 153, so that the coupling portion 152 inserted into the top driver coupling groove 211 is not separated from the top 200.

The top 200 can be easily coupled to or decoupled from the top driver 150 by the V-shape of the coupling portion 152.

The top 200 includes the blade 210 which is coupled to the top driver 150 of the launcher 100 to be rotated by the top driver, is selectively separated from the top driver 150 according to operation of the launcher button 140, and moves the spinning top, a top shaft 220, a top housing 230, a top bottom 240, and a bottom rotation shaft 250.

The blade 210 is a metallic disc, and is formed with the plurality of top driver coupling grooves 211 along its circumference to be coupled to the coupling portions 152 of the top driver 150.

The top shaft 220 is installed to a lower portion of the blade 210, and has a rectangular upper end to be firmly fixed to the blade and thus prevent relative rotation, or a knurled upper end to prevent slippage thereof.

The top housing 230 is a cylindrical member which is installed to the lower portion of the blade 210 to receive the top shaft 220 in a rotatable state, and is supported by an upper bearing 221 and a lower bearing 222 to enable the top shaft 220 to freely rotate.

The bottom 240 is detachably installed to a bottom coupling portion 231 formed at a lower portion of the top housing 230 to provide the top 200 with a rotation shaft, and has a bottom rotation shaft 250 and a spring 251.

The bottom rotation shaft 250 is a protruding member of a desired shape which is concentrically installed to the top shaft 220, and is fixed by the bottom 240. The bottom rotation shaft 250 can be replaced by a new rotation shaft of any shape, according to selection of the user, after the bottom 240 is separated from the top housing 230.

The spring 251 is installed between the bottom rotation shaft 250 and the top shaft 220 to provide the resilience force so that a desired interval is maintained between the bottom rotation shaft 250 and the top shaft 220.

Specifically, the spring 251 absorbs the impact when the top 200 is separated from the launcher 100, and then the bottom rotation shaft 250 of the separated top 200 collides against the ground, thereby preventing the rotational force of the top from being decreased.

The bottom 240 according to the present invention is characterized by being detachably coupled to the top housing 230, thereby replacing the bottom rotation shaft 250.

The winder 300 is configured so that a portion of the winder is inserted into the winder coupling portion 120 of the launcher 100, and then is horizontally moved along the winder coupler 120 so as to rotate the pinion gear 130. The winder has a rack gear 310, a winder tab 320, a winder coupling portion inserting groove 330, and a winder guide 340.

The rack gear 310 is a member having a strap-shaped body with a rack gear formed on one side thereof, and has a desired width.

The winder tab 320 is formed at the other end of the rack gear 310, so that the user can pull the rack gear 310 by holding the winder tab.

The winder coupling portion inserting groove 330 is an insertion portion which is formed by cutting the rack gear 310 in a longitudinal direction to have a desired size so that the rack gear 310 is inserted into the cut space of the winder coupling portion 120. No rack gear is formed in the winder coupling portion inserting groove 330 in which the pinion gear 130 is not meshed.

The winder guide 340 is formed on one side of the winder coupling portion inserting groove 330, so as to guide the winder coupling portion inserting groove 330 in the horizontal direction, without coming out from the winder coupling portion 120, while the rack gear 310 is pulled out in the state in which the winder coupling portion 120 is inserted into the winder coupling portion inserting groove 330.

The operation of the spinning top toy according to the first embodiment will now be described.

In the state in which the user holds the tab 111 of the launcher 100, the top 200 is mounted onto the launcher 100 in such a way that the coupling portions 152 of the top driver 150 are coupled to the top driver coupling grooves 211 formed on the blade 210 of the top 200, and the stepped portions 153 support the lower end of the blade 210.

If the top 200 is mounted, the winder coupling portion 120 is inserted and fitted through the winder coupling portion inserting groove 330 of the winder 300, and thus the winder 300 is coupled to the side of the launcher 100.

In the state in which the winder 300 is coupled to the side of the launcher 100, if the user pulls the winder 300 out in the horizontal direction, the pinion gear 130 of the launcher 100 is meshed with the rack gear 310 of the winder 300 to rotate the pinion gear 130.

If the pinion gear 130 rotates, the top driver 150 also rotates in cooperation with the pinion gear 130 to provide the top with the rotational force.

After that, in order to provide the top 200 with additional rotational force, the top 200 is transmitted with the increased rotational force by inserting the winder 300 into the side of the launcher 100 and then pulling the winder out.

In the state in which the top 200 is transmitted by the sufficient rotational force, if the user moves the launcher 100 and the top 200 to any position, and then pushes the launcher button 140, the launch button firing pin 142 moves the launcher 100 in the vertical direction to press the top surface of the blade 210 of the top 200. The top 200 supported by the stepped portions 153 is separated from the top driver 150, and then is released from the launcher 100.

The released top 200 is rotated by the rotational inertia of the top shaft 220 and the blade 210 even though the user holds the top housing 230, and thus can maintain the rotation state, thereby enabling the spinning top to move.

Accordingly, the top can be moved in the state in which the top is rotating after the top is released from the launcher. Also, the rotating state of the top can be maintained in the launcher, and the spinning top can be released at the wanted launch position. In addition, the winder can be easily coupled to the launcher in the state in which the top is coupled to the launcher and is rotated, thereby increasing the rotational force.

Second Embodiment

FIG. 8 is an exploded perspective view illustrating the configuration of a launcher for a spinning top toy according to the second embodiment of the present invention. FIG. 9 is a cross-sectional view illustrating the configuration of the launcher for the spinning top toy in FIG. 8. FIG. 10 is a perspective view illustrating an assembled state of the spinning top toy in FIG. 8.

The spinning top toy according to the second embodiment includes, as illustrated in FIGS. 8 to 10, a launcher 100' having a winder coupling portion 120 which is formed at one side of the launcher housing 110' by cutting the side in such a way that a portion of the winder 300 is inserted into the space and is brought into closely contact with the winder coupling portion, a pinion gear 130' which is meshed with and rotated by the winder 300, a top driver 150 for rotating the top 200 in cooperation with the pinion gear 130', and a launch firing pin 140' which penetrates the launcher housing 110', the pinion gear 130', and the top driver 150 and is moved in a vertical direction by a protrusion 311 installed to a distal end of the winder 300 so as to press the top 200, thereby separating the top 200 from the top driver 150; the top 200 which is coupled to and rotated by the top driver 150 of the launcher 100', and is selectively separated from the top driver 150 according to operation of the launch firing pin 140'; and the winder 300 which is horizontally moved along the winder coupling portion 120 to rotate the pinion gear 130', so that the launch firing pin 140' is moved in a vertical direction of the launcher 100', with a portion of the winder being inserted into the winder coupling portion 120 of the launcher 100'.

In the following description on the second embodiment, like reference numerals are attached to elements identical to those in the first embodiment, and the description thereof is omitted.

The launcher 100' according to the second embodiment is substantially identical to the launcher 100 according to the first embodiment, except for the pinion gear 130', the launch firing pin 140', and a part of the winder 300.

The launcher 100' includes a launcher housing 110 which receives a portion of the winder 300 at one side, transmits the rotational force generated by horizontal movement of the winder 300 to the top 200 coupled to a lower portion to rotate the top 200, and separates the spinning top 200 at an any position from the launcher 100', a winder coupling portion 120, a pinion gear 130', a launch firing pin 140', and the top driver 150.

The pinion gear 130' is installed in the launcher housing 110', and is meshed with the winder 300 to rotate the top driver 150, and has a lower bearing 131' and an upper bearing 132' which are rotatably installed in the launcher housing 110' and support a rotation shaft of the pinion gear 130' on the launcher housing 110' so that the pinion gear 130' can smoothly rotate in the launcher housing 110'. The pinion gear 130' and the upper bearing 132' are formed with a through-hole, through which the launch firing pin 140' can penetrate.

The pinion gear 130 has fixing bosses **130*b'* for preventing the top driver 150**, which is coupled to the lower end, from being separated during rotation.

The launch firing pin 140' is a top separator which is moved in the vertical direction by the winder 300 to press the top surface of the top 200, and has a launch firing pin body 141', a firing pin guide 142', a firing pin 143', and a spring 144'.

The firing pin body 141' is formed in an inverted conical shape, and the whole launch firing pin 140' is vertically upwardly moved by the protrusion 311 provided on the distal end of the winder 300.

The launch firing pin guide 142' extends from the top surface of the launch firing pin body 141' to have a desired length, and guides the launch firing pin 140' so that the launch firing pin penetrates the upper bearing 132' and moves upwardly.

The firing pin 143' extends from the bottom surface of the launch firing pin body 141' to have a desired length, and a distal end of the firing pin 143' strikes the top 200 to be separated from the launcher 100'.

The spring 144' is configured to resiliently press the launch firing pin body 141' in a downward direction. If the launch firing pin body 141' is upwardly moved by the winder 300, the spring 144' provides a resilient force for enabling the fining pin 143' to strike the top 200, and a resilient force for returning the launch firing pin body 141' to its original position.

The top driver 150 has a pinion gear engaging groove 151 formed at a body center of the top driver 150 to be rotated in cooperation with the pinion gear 130', and is coupled to the rotation shaft of the pinion gear 130'. The top driver 150 is rotatably installed to the bottom surface of the launcher housing 110'. Coupling portions 152 extend downwardly from the bottom surface of the top driver 150 to be detachably coupled to top driver coupling grooves 211 which are formed on a circumference of blades 210 of the top 200.

Also, the top driver 150 has a fixing groove **151*a* formed in the pinion gear engaging groove 151 which is engaged to the fixing bosses 130*b'* formed on the lower end of the pinion gear 130' to prevent the top driver 150** from being separated during rotation.

The winder 300 is provided with a rack gear portion 310 of a strap shape having the rack gear formed on one side. The rack gear portion 310 has a protrusion 311 of a desired size protruding from a distal end thereof, and a winder tab 320 formed on the other end. The winder is also provided with a winder coupling portion inserting groove 330 which is formed by cutting the rack gear portion 310 in a longitudinal direction to have a desired size so that the rack gear portion 310 is inserted into the winder coupling portion inserting groove. When the winder 300 is pulled out, the protrusion 311 presses a lower end of the launch firing pin body 141', and then the launch firing pin 140' moves above the launcher 100'.

The operation of the spinning top toy according to the second embodiment will now be described.

In the state in which the user holds the tab 111 of the launcher 100', the top 200 is mounted onto the launcher 100' in such a way that the coupling portions 152 of the top driver 150 are coupled to the top driver coupling grooves 211 formed on the blade 210 of the top 200, and the stepped portions 153 support the lower end of the blade 210.

If the top 200 is mounted, the winder coupling portion 120 is inserted and fitted through the winder coupling portion inserting groove 330 of the winder 300, and thus the winder 300 is coupled to the side of the launcher 100'.

In the state in which the winder 300 is coupled to the side of the launcher 100', if the user pulls the winder 300 out in the horizontal direction, the pinion gear 130' of the launcher 100' is meshed with the rack gear 310 of the winder 300 to rotate the pinion gear 130'.

If the pinion gear 130' rotates, the top driver 150 also rotates in cooperation with the pinion gear 130' to provide the top with the rotational force.

When the winder 300 is pulled out, the protrusion 311 formed on the distal end of the rack gear portion 310 presses the launch firing pin 140' in the upward direction, and then the launch firing pin is moved upward and then is separated from the launcher 100'. The launch firing pin 140' is moved downward by the resilient force of the spring 144', and the firing pin 143' presses (strikes) on the top surface of the blade 210 of the top 200. The top 200 supported by the stepped portion 153 is separated from the top driver 150, and then is launched from the launcher 100'.

Third Embodiment

FIG. 11 is an exploded perspective view illustrating the configuration of a launcher for a spinning top toy according to the third embodiment of the present invention.

The spinning top toy according to the third embodiment includes, as illustrated in FIG. 11, a launcher 100" having a winder coupling portion 120 which is formed at one side of the launcher housing 110 by cutting the side in such a way that the winder 300 is inserted into the space, a pinion gear 130 which is meshed with and rotated by the winder 300, a top driver 150 for rotating the top 200 in cooperation with the pinion gear 130, and a stopper 160 which is installed at one side of the launcher housing 110 to be meshed with the pinion gear 130, and stops the rotation of the pinion gear 130 so as to separate the top from the top driver 150 by the inertia if the rotation of the pinion gear 130 is stopped; the top which is coupled to and rotated by the top driver 150 of the launcher 100", and is selectively separated from the top driver 150 according to operation of the stopper 160; and the winder which is horizontally moved along the winder coupling portion 120 to rotate the pinion gear 130', with a portion of the winder being inserted into the winder coupling portion 120 of the launcher 100".

In the following description on the third embodiment, like reference numerals are attached to elements identical to those in the first embodiment, and the description thereof is omitted.

The launcher 100" according to the third embodiment is substantially identical to the launcher 100 according to the first embodiment, except for the launcher 100". The launcher 100" stops the rotation of the pinion gear 130, so that the top is separated from the launcher 100" by the rotational inertia. The launcher 100" includes the launcher housing 110, the winder coupling portion 120, the pinion gear 130, the top driver 150, and the stopper 160.

The stopper 160 is a top separator which is installed to a stopper installing hole 114 formed on one side of the launcher housing 110 so as to selectively forcibly the rotation of the pinion gear 130. The stopper 160 has a stopper button 161 formed on one side, a stopper shaft 162 extending from the stopper body 161 in a desired length and meshing with the pinion gear 130, and a spring 163 for providing a resilient force so that the stopper shaft 162 is spaced apart from the pinion gear 130 in a desired distance, and returning the stopper shaft 162 to its original position after the stopper shaft 162 moves and then meshes with the pinion gear 130.

Specifically, while the pinion gear 130 is freely rotated by the rotational force supplied from the winder 300, if the user pushes the stopper 160, the end of the stopper shaft 162 is meshed with the pinion gear 130 to forcibly stop the rotation of the pinion gear 130.

The spring 163 is installed between the topper button 161 and the launcher housing 110 to provide the resilience force so that the stopper button 161 is spaced apart from the pinion gear 130 in a desired distance, and to return the stopper 160 to its original position after the stopper 160 moves and then meshes with the pinion gear 130.

As illustrated in FIG. 12, the launcher 100" may further have an acceleration pinion gear 133 which is meshed with the pinion gear 130 to increase the number of revolutions of the pinion gear 130 to be rotated by the winder 300.

Specifically, the acceleration pinion gear 133 is installed to one side of the pinion gear 130, and has a first gear 133*a* which is meshed with the winder 300, and a second gear 133*b* which is formed conically with the first gear 133*a* to be meshed with the pinion gear 130 and has a diameter lager than that of the first gear 133*a*.

The first gear 133*a* is a gear of a desired diameter, and if the first gear is meshed and rotated with the rack gear formed on the winder 300, the second large gear 133*b* which is formed integrally with the first gear 133*a* is rotated at faster revolutions, so that the pinion gear 130 produces bigger rotational force, thereby providing the top with the sufficient rotational force.

As illustrated in FIG. 13, an idle gear 134 may be installed between the pinion gear 130 and the acceleration pinion gear 133 so that the rotation direction of the pinion gear 130 is equal to that of the acceleration pinion gear 133.

In this embodiment, if the user pushes the stopper button 161, the stopper 160 operates. However, the stopper can be operated by the winder 300.

Referring to FIG. 14, the stopper 160' is a U-shaped member which is installed around the pinion gear 130 to selectively forcibly stop the rotation of the pinion gear 130. The stopper 160' has a protrusion 161' which is formed on an outside thereof to be engaged to the spring 163, a stopper shaft 162' which extends from an inside thereof in a desired length to be meshed with the pinion gear 130, and a spring 163' which is engaged to the protrusion 161' to resiliently maintain a proper position of the stopper 160'.

With the above configuration of the stopper 160', the pinion gear 130 is meshed with and fixed by the stopper shaft 162' so that the pinion gear 130 is not rotated by the resilient force of the spring 163', as illustrated in FIG. 15*a*. If the winder 300 moving along the first upper guide or the first lower guide 121*b* of the winder coupling portion 120 is inserted, the stopper 160' is pressed and moved by the winder 300, as illustrated in FIG. 15*b*, and thus the pinion gear 130 is separated from the stopper shaft 162', so that the pinion gear 130 can freely rotate while moving. If the winder 300 is released from the launcher 100", the pinion gear 130 is meshed with the stopper shaft 162' by the resilient force of the spring 163', thereby forcibly stopping the rotation of the pinion gear 130.

The operation of the spinning top toy according to the third embodiment will now be described.

In the state in which the user holds the tab 111 of the launcher 100", the top 200 (see FIG. 6) is mounted onto the launcher 100" in such a way that the coupling portions 152 of the top driver 150 are coupled to the top driver coupling grooves 211 (see FIG. 6) formed on the blade 210 (see FIG. 6) of the top 200, and the stepped portions 153 support the lower end of the blade 210.

If the top 200 is mounted, the winder coupling portion inserting groove 330 of the winder 300 (see FIG. 2) is inserted and fitted through the winder coupling portion 120, and thus the winder 300 is coupled to the side of the launcher 100".

In the state in which the winder 300 is coupled to the side of the launcher 100", if the user pulls the winder 300 out in the horizontal direction, the pinion gear 130 of the launcher 100" is meshed with the rack gear 310 of the winder 300 to rotate the pinion gear 130.

If the pinion gear 130 rotates, the top driver 150 also rotates in cooperation with the pinion gear 130 to provide the top with the rotational force.

In the case where the sufficient rotational force is not produced in the process of pulling the winder 300 out, the winder coupling portion 120 of the launcher 100" is again inserted into the winder coupling portion inserting groove 330. By pulling the winder tab 320 out in the state in which the winder 300 is engaged to the launcher 100", the pinion gear 130 is provided with the increased rotational force, and thus the top 200 can be rotated at a higher speed.

If the stopper shaft 162 is meshed with the pinion gear 130 by pushing the stopper 160 while the top 200 is spinning, the rotation of the pinion gear 130 is stopped. At this time, the top driver 150 which is engaged to the pinion gear 130 and thus is rotated is stopped.

If the rotation of the top driver 150 is stopped, the rotational inertial is produced from the top 200 coupled to the coupling portions 152, and the top 200 is moved toward the rotational direction by the produced rotational inertia.

If the top 200 is moved toward the rotational direction by the produced rotational inertia, the blade 210 exceeds the supporting force of the stepped portions 153, and thus the top 200 moves toward the rotational direction along the slope of the coupling portions 152 so as to be separated from the top driver, so that the top 200 having the sufficient rotational force is launched from the launcher 100".

Fourth Embodiment

FIG. 16 is a perspective view illustrating a spinning top toy according to the fourth embodiment of the present invention. FIG. 17 is an exploded perspective view illustrating the configuration of a launcher for the spinning top toy in FIG. 16. FIG. 18 is an exploded perspective view illustrating a coupled state of the launcher for the spinning top toy in FIG. 16.

In the following description on the fourth embodiment, like reference numerals are attached to elements identical to those in the first embodiment, and the description thereof is omitted.

The spinning top toy according to the fourth embodiment includes, as illustrated in FIGS. 16 to 18, a launcher 100''' having a winder coupling portion 120 which is formed at one side of the launcher housing 110 by cutting the side in such a way that a portion of the winder 300 is inserted into the space and is brought into closely contact with the winder coupling portion, a pinion gear 130" which is meshed with and rotated by the winder 300, a top driver 150' for rotating the top 200 in cooperation with the pinion gear 130", and a launch operator 140" which penetrates the launcher housing 110, the pinion gear 130", and the top driver 150' and is connected to the top driver 150' to move the top driver 150' in the vertical direction, so that coupling portions 152' supporting the top 200' are moved, and thus the top 200' is separated from the top driver 150'; the top 200' which is coupled to and rotated by the top driver 150' of the launcher 100', and is selectively separated from the top driver 150' according to operation of the launch operator 140"; and the winder 300 which is horizontally moved along the winder coupling portion 120 to rotate the pinion gear 130", so that the launch operator 140" is moved upward, with a portion of the winder being inserted into the winder coupling portion 120 of the launcher 100'".

The spinning top toy according to the fourth embodiment is substantially identical to that according to the first embodiment, except for the launcher 100'" and the top 200'.

More specifically, the launcher 100'" is configured so that the pinion gear 130" and the launch operator 140" are rotated together, and the top driver 150' is moved in the vertical direction, thereby separating the top 200' from the launcher 100'" in accordance with the operation of the coupling portions 152'. The top 200' is formed on the top surface thereof with top driver inserting grooves 212.

The pinion gear 130" is rotatably installed in the launcher housing 110, and is meshed with the winder 300 to rotate the top driver 150'. The pinion gear 130" has a through-hole 130*a* formed at a center thereof, and a keyed groove 130*b*" formed on an inner surface of the through-hole 130*a*" to allow the launch operator 140" to rotate with the pinion gear 130".

Also, the pinion gear has a lower bearing 131" which supports a rotation shaft of the pinion gear 130" on the launcher housing 110 so that the pinion gear 130" can smoothly rotate in the launcher housing 110, and an upper bearing 132" which supports a rotation shaft of the launch operator 140" so that the launch operator 140" can smoothly rotate in the launcher housing 110.

The launch operator 140" is a top separator which is installed to penetrate the launcher 100'" in the vertical direction and separates the top 200' from the top driver 150' after the launch operator 140", to which the top is engaged, vertically moves to the upper portion. The launch operator 140" is rotatably installed to the launch button installing hole 112 through the upper bearing 132", and penetrates the pinion gear installing hole 113 of the lower housing 110*b* to be engaged to the top driver 150'. If inverted conical body of the launch operator is engaged to the protrusion 311 protruding from the distal end of the winder 300, the launch operator 140" is vertically upwardly moved, and thus the top driver 150' engaged to the distal end of the launch operator 140" is also vertically upwardly moved, and is returned to its original position by the spring 144".

The launch operator 140" has a key 145" which is fitted into the keyed groove 130*b*" of the pinion gear 130", so as to rotate with the pinion gear 130".

The top driver 150' has a lower housing 150*a*', an upper housing 150*b*', a pair of connectors 152', and a support 157'.

The lower housing 150*a*' is formed with a pinion gear engaging groove 151' to which the launch operator 140" is engaged, and elongated coupling portion penetrating holes 170 through which the coupling portions 152' for fixing the top 200' penetrates.

The top housing 150*b*' is installed on the lower housing 150*a*', and is formed with a first through-hole 171 through which the launch operator 140" penetrates, and second through-holes 172 through which insertion bosses 157*a*' of the support 157' penetrate.

The coupling portions 152' are installed in the coupling portion penetrating holes 170 of the lower housing 150*a*' to be able to move to each other. The coupling portions 152' are spaced apart from each other in a desired distance, and a distal end of each coupling portion 152' is formed with a stepped portion 153' to fix the top 200'.

An upper end of each coupling portion 152' is formed with a coupling portion guide 154' having an inclined groove. A spring fixing portion 155' is installed to one side of the coupling portion 152', and a spring 156' is fixed to the spring fixing portion 155' to resiliently maintain a gap between the coupling portions 152' at a regular distance.

The support 157' is placed below the bottom surface of the lower housing 110*b*, and the inclined insertion bosses 157*a*' formed at the distal ends thereof penetrate the second through-holes 172 of the upper housing 150*b*'. The insertion boss 157*a*' is fitted into the inclined coupling portion guide 154' of the coupling portion 152' so that the coupling portion 152' is supported to move inwardly in a radial direction, thereby closing the coupling portions 152'.

The top 200' is formed on the top surface thereof with the plurality of elongated top driver inserting grooves 212 to which the coupling portions 152' of the top driver 150' are fitted. The top 200' includes a blade 210' having a top shaft fixed to a lower portion thereof, a top housing 230' which is installed to the lower portion of the blade 210' to accommodate the top shaft in a rotatable state, and a bottom 240' which is installed to a lower portion of the top housing 2230' to form a rotation shaft around which the top 200' rotates.

The bottom 240' has a bottom rotation shaft 250' which serves as a rotation shaft for the top 200', and the bottom rotation shaft 250' is a protruding member of a desired shape which is concentrically installed to the top shaft, and is fixed by the bottom 240'. The bottom rotation shaft 250' can be replaced by a new rotation shaft of any shape, according to selection of the user, after the bottom 240' is separated from the top housing 230'.

A spring is installed between the bottom rotation shaft 250' and the top shaft to provide the resilience force so that a desired interval is maintained between the bottom rotation shaft 250' and the top shaft. The spring absorbs the impact when the bottom rotation shaft of the top 200' collides against the ground, thereby preventing the rotational force of the top from being decreased.

The operation of the spinning top toy according to the fourth embodiment will now be described.

In the state in which the user holds the tab 111 of the launcher 100'", the top 200' is mounted onto the launcher 100'" in such a way that the coupling portions 152' of the top driver 150' are coupled to the top driver coupling grooves 212 formed on the blade 210' of the top 200', and the stepped portions 153 support the blade 210'.

If the top 200' is mounted, the winder coupling portion 120 is inserted and fitted through the winder coupling portion inserting groove 330 of the winder 300, and thus the winder 300 is coupled to the side of the launcher 100'".

In the state in which the winder 300 is coupled to the side of the launcher 100'", if the user pulls the winder 300 out in the horizontal direction, the pinion gear 130" of the launcher 100'" is meshed with the rack gear 310 of the winder 300 to rotate the pinion gear 130".

If the pinion gear 130" rotates, the top driver 150' also rotates in cooperation with the pinion gear 130" to provide the top 200' with the rotational force.

When the winder 300 is pulled out, the protrusion formed on the distal end of the rack gear 310 presses the launch operator 140" in the upward direction, and then is separated from the launcher 100'''. After that, the launch operator 140'' is moved upwardly, and the top driver 150' is also moved upwardly.

If the top driver 150' is moved upwardly, the support 157' is brought into close contact with the bottom surface of the lower housing 110*b*, and thus no more moves. The insertion boss 157*a*' of the support 157' penetrates the second through-hole 172 of the top driver 150', and is fitted into the inclined coupling portion guide 154' of the coupling portion 152'.

In this instance, the coupling portions 152' are inwardly moved in the radial direction to be closed by the inclined surface of the coupling portion guide 154', and thus the top 200' supported by the stepped portion 153' of the coupling portion 152' is separated from the launcher 100'''.

If the launch operator 140'' is downwardly returned to its original position by the self-weight after the top 200' is separated, the coupling portion guides 154' are also moved, and thus the coupling portions 152', which are closed by the insertion boss 157*a*' of the support 157', are outwardly opened to its original position by the resilient force of the spring 156'.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In each of the drawings used in the above description, the thickness of the lines or the scale of each element is modified appropriately in order to make it recognizable. In addition, it is noted that in this embodiment some terminologies are arbitrary defined and used in view of the function thereof, and are not limited as long as they can attain the present invention since those terminologies can be varied depending upon intention of users or operators.

BRIEF DESCRIPTION OF REFERENCE NUMERALS

100, 100' 100'', 100''': Launcher
110: Launcher housing
110*a*: Upper housing
110*b*: Lower housing
111: Tab
112: Launch button installing hole
113: Pinion gear installing hole
114: Stopper installing hole
120: Winder coupling portion
121*a*: First upper guide
121*b*: First lower guide
122: Second guide
123: Gear penetrating portion
130, 130': Pinion gear
130*a*, 130*a*': Through-hole
130*b*': Fixing boss
131, 131': Lower bearing
132, 132': Upper bearing
132*a*: Through-hole
140: Launch button
140': Launch firing pin
141: Launch button body
141': Launch firing pin body
142: Launch button firing pin
142': Launch firing pin guide
143: Spring
143': Firing pin
144': Spring
150: Top driver
151: Pinion gear engaging groove
151*a*': Fixing groove
152: Coupling portion
153: Stepped portion
160: Stopper
161: Stopper button
162: Stopper shaft
163: Spring
200: Top
210: Blade
211: Top driver coupling groove
220: Top shaft
221: Upper bearing
222: Lower bearing
230: Top housing
231: Bottom coupling portion
240: Bottom
250: Winder
310: Rack gear
311: Protrusion
340: Winder guide

The invention claimed is:

1. A spinning top toy, comprising:

a launcher having a winder coupling portion which is cut to allow a portion of a winder inserted from a side direction to move, a guide formed at a cut end portion to provide a route for the winder to move, a pinion gear which is meshed with and rotated by the winder, a top driver for rotating a top in cooperation with the pinion gear, and a top separator which is configured to separate the top from the top driver;

the top which is coupled to a lower portion of the launcher, and is selectively separated from the top driver according to operation of the top separator of the launcher; and the winder with a portion inserted into a side of the launcher through the winder coupling portion of the launcher to be meshed with the pinion gear, the winder being horizontally moved along the winder coupling portion in an insertion state to rotate the pinion gear, the winder comprising a rack gear portion having a gear formed on a side of the rack gear portion to rotate the pinion gear, a winder coupling portion inserting groove formed by cutting a predetermined size to be inserted into the wind coupling portion, a pull tab formed on a front end of another side of the rack gear portion, and a protrusion of a desired size protruding from a distal end of the rack gear portion.

2. A spinning top toy, comprising:

a launcher having a winder coupling portion which is formed at a side of a launcher housing by cutting the side of the launcher housing so that a portion of a winder is inserted into the side of the launcher housing and is moved, a pinion gear which is meshed with and rotated by the winder, a top driver for rotating a top in cooperation with the pinion gear, and a top separator which is configured to separate the top from the top driver;

the top which is coupled to a lower portion of the launcher, and is selectively separated from the top driver according to operation of the top separator of the launcher; and the winder with a portion being inserted into the winder coupling portion of the launcher, the winder being horizontally moved along the winder coupling portion in an insertion state to rotate the pinion gear, the winder comprising a rack gear portion having a gear formed on a side of the rack gear portion to rotate the pinion gear, a winder coupling portion inserting groove formed by cutting a predetermined size to be inserted into the wind coupling portion, a pull tab formed on a front end of another side of the rack gear portion, and a protrusion of a desired size protruding from a distal end of the rack gear portion.

3. The spinning top toy according to claim 2, wherein the launcher further comprises an acceleration pinion gear meshed with the pinion gear to increase the number of revolutions of the pinion gear to be rotated by the winder.

4. The spinning top toy according to claim 2, wherein:

the top separator of the launcher comprises a launch button which penetrates the launcher housing, the pinion gear, and the top driver, and the launch button is configured to be operated by a press force to press the top, so that the top is separated from the top driver.

5. The spinning top toy according to claim 2, wherein:

the top separator of the launcher comprises a launch firing pin which penetrates the launcher housing, the pinion gear, and the top driver, and the launch firing pin is configured to be operated by a press force to press the top, so that the top is separated from the top driver.

6. The spinning top toy according to claim 2, wherein the top separator of the launcher comprises a stopper which is placed at the side of the launcher housing, and is meshed with the pinion gear to stop rotation of the pinion gear, so that the top is separated from the top driver by an inertial force.

7. The spinning top toy according to claim 6, wherein the stopper comprises a stopper shaft which is installed at a side of the pinion gear, and is meshed with the pinion gear to selectively stop the rotation of the pinion gear, and a spring for providing a resilient force to the stopper shaft so that the stopper shaft is kept at a proper position.

8. The spinning top toy according to claim 2, wherein the top separator of the launcher comprises a launch operator which penetrates the launcher housing, the pinion gear, and the top driver, and is configured to move the top driver in a vertical direction, so that the top is separated from the top driver.

9. The spinning top toy according to claim 8, wherein the top driver has a lower housing which is formed with a pinion gear engaging groove, to which the top separator is engaged, and a coupling portion penetrating hole through which the coupling portion penetrates, a top housing which is installed on the lower housing, and is formed with a first through-hole through which the top driver penetrates, and a second through-hole through which an insertion boss of the support penetrates, a pair of coupling portions which are installed in coupling portion penetrating holes of the lower housing to be able to move to each other, the coupling portions being spaced apart from each other in a desired distance, and which are formed with a stepped portion at a distal end thereof, a coupling portion guide which is formed at an upper end of each coupling portion, and has an inclined groove, a spring which is installed between the coupling portions to resiliently maintain a gap between the coupling portions at a desired distance, and a support which has an inclined insertion boss formed at distal end thereof which penetrates the upper housing, the insertion boss being fitted into the coupling portion guide of the coupling portion so that the coupling portion is supported to move inwardly in a radial direction.

10. The spinning top toy according to claim 2, wherein the top driver comprises a plurality of coupling portions which extend from a bottom surface thereof in a desired length and are configured to couple to a blade of the top.

11. The spinning top toy according to claim 2, wherein the top comprises:

a blade which is formed with a top driver coupling groove to be coupled to the coupling portion of the top driver, a top shaft which is fixed to a lower portion of the blade, a top housing which is installed to the lower portion of the blade to receive the top shaft in a rotatable state, and a bottom which is detachably installed to a lower portion of the top housing and has a bottom rotation shaft so that the top spins on the ground.

12. The spinning top toy according to claim 11, wherein the bottom rotation shaft is detachably coupled to the bottom, so that the bottom rotation shaft can be replaced.

13. The spinning top toy according to claim 11, wherein the bottom further has a spring which is installed between the top shaft and the bottom rotation shaft to provide a resilience force so that a desired interval is maintained between the bottom rotation shaft and the top shaft.

14. The spinning top toy according to claim 2, wherein the top comprises:

a blade which is formed at an upper portion thereof with a plurality of top driver coupling grooves to be coupled to the coupling portions of the top driver, and at a lower portion thereof with a top shaft, a top housing which is installed to the lower portion of the blade to receive the top shaft in a rotatable state, and a bottom which is installed to a lower portion of the top housing to support the top in a rotatable state.

* * * * *